US010307778B2

(12) United States Patent
Fujiwara et al.

(10) Patent No.: US 10,307,778 B2
(45) Date of Patent: Jun. 4, 2019

(54) TRIGGER-TYPE LIQUID DISPENSER

(71) Applicants: Kotaro Fujiwara, Tokyo (JP); Shigeo Iizuka, Tokyo (JP)

(72) Inventors: Kotaro Fujiwara, Tokyo (JP); Shigeo Iizuka, Tokyo (JP)

(73) Assignee: YOSHINO KOGYOSHO CO., LTD., Tokyo (JP)

( * ) Notice: Subject to any disclaimer, the term of this patent is extended or adjusted under 35 U.S.C. 154(b) by 0 days.

(21) Appl. No.: 15/536,563

(22) PCT Filed: Nov. 20, 2015

(86) PCT No.: PCT/JP2015/005804
§ 371 (c)(1),
(2) Date: Jun. 15, 2017

(87) PCT Pub. No.: WO2016/103569
PCT Pub. Date: Jun. 30, 2016

(65) Prior Publication Data

US 2017/0333931 A1 Nov. 23, 2017

(30) Foreign Application Priority Data

Dec. 26, 2014 (JP) ..... 2014-265113

(51) Int. Cl.
*B05B 11/00* (2006.01)
*B05B 1/12* (2006.01)
*B05B 7/00* (2006.01)

(52) U.S. Cl.
CPC ..... *B05B 11/3057* (2013.01); *B05B 1/12* (2013.01); *B05B 11/0029* (2013.01);
(Continued)

(58) Field of Classification Search
CPC ... B05B 11/3057; B05B 1/12; B05B 11/3011; B05B 11/0029; B05B 11/0032; B05B 11/3045; B05B 7/005
See application file for complete search history.

(56) References Cited

U.S. PATENT DOCUMENTS 4,204,614 A 5/1980 Reeve
4,516,695 A * 5/1985 Garneau ..... B05B 1/12 222/153.14
(Continued)

FOREIGN PATENT DOCUMENTS

EP 0 467 554 A1 1/1992
JP H04-227086 A 8/1992
(Continued)

OTHER PUBLICATIONS

Feb. 16, 2016 International Search Report issued in International Patent Application No. PCT/JP2015/005804.
(Continued)

*Primary Examiner* — David P Angwin
*Assistant Examiner* — Bob Zadeh
(74) *Attorney, Agent, or Firm* — Oliff PLC

(57) ABSTRACT

A trigger-type liquid dispenser includes a dispenser main body, pump, and nozzle. The body includes a fitted portion, which communicates with a delivery port. The nozzle includes a partition wall, which covers an opening end of the fitted portion and has a dispensing hole, and an outer circumferential wall. The nozzle is rotatable with respect to the fitted portion between an opened position, wherein the hole communicates with the port, and a closed position, wherein the hole is blocked. The outer circumferential wall includes a locking projection, in undercut engagement with a projecting portion, on an outer surface of the fitted portion, to hold the nozzle in engagement with the fitted portion. The locking projection, in an inner edge portion thereof, has a
(Continued)

concave portion, wherein the degree of undercut engagement with the projecting portion is reduced when the nozzle is located between the opened and the closed position.

8 Claims, 3 Drawing Sheets

(52) U.S. Cl.
CPC ..... *B05B 11/0032* (2013.01); *B05B 11/3011* (2013.01); *B05B 11/3045* (2013.01); *B05B 7/005* (2013.01)

(56) References Cited

U.S. PATENT DOCUMENTS 5,938,081 A * 8/1999 Foster ..... B65D 41/0471 222/153.09
5,938,082 A * 8/1999 Foster ..... B05B 11/001 215/318
6,557,783 B1 5/2003 Foster et al.
7,036,689 B1 5/2006 Laffey
8,684,235 B2 * 4/2014 Inaba ..... B05B 11/0029 222/153.13
2004/0251316 A1 * 12/2004 Stark ..... B05B 11/0029 239/333
2007/0114303 A1 5/2007 Hildebrand
2007/0228187 A1 * 10/2007 Nelson ..... B05B 11/0029 239/337
2007/0295757 A1 * 12/2007 Foster ..... B05B 15/40 222/340
2014/0091111 A1 * 4/2014 Dennis ..... B05B 11/001 222/382
2017/0014844 A1 * 1/2017 Fujiwara ..... B05B 11/3002
2017/0120277 A1 * 5/2017 Fujiwara ..... B05B 11/00
2017/0333931 A1 * 11/2017 Fujiwara ..... B05B 1/12

FOREIGN PATENT DOCUMENTS

JP H09-313998 A 12/1997
JP H11-290731 A 10/1999
JP 2000-289767 A 10/2000
JP 2001-038258 A 2/2001
JP 2010/172864 A 8/2010
JP 2011-031938 A 2/2011

OTHER PUBLICATIONS

Sep. 5, 2018 Office Action issued Chinese Patent Application 201580070564.5.
Jul. 3, 2018 Extended Search Report issued in European Patent Application No. 15872147.2.
Mar. 4, 2019 Office Action issued in Chinese Patent Application No. 201580070564.5.

* cited by examiner

TRIGGER-TYPE LIQUID DISPENSER

TECHNICAL FIELD

The present disclosure relates to a trigger-type liquid ejection device (hereinafter, called the trigger-type liquid dispenser) that is attached to a mouth of a container containing a liquid and that dispenses the liquid contained in the container through a nozzle.

BACKGROUND

Dispensers may be attached to mouths of containers containing liquids, such as an antimold, a detergent, a sizing agent for textiles, household wax, a hair liquid, an aromatic, a repellent, a pesticide, and a medicine. As an example of such a dispenser, an existing trigger-type liquid dispenser dispenses such a liquid in the form of spray or foam through a nozzle by actuating a pump in response to operation of a trigger.

Such a trigger-type liquid dispenser includes a dispenser main body fitted to the mouth of the container by, for example, a fitting cap. The dispenser main body is fitted with a pump and is also provided with a delivery flow path of the liquid pressure-fed to the pump, and the nozzle is fitted to a delivery port, which is an outlet end of the delivery flow path. The nozzle is provided with a dispensing hole having a smaller diameter than the delivery flow path. After pressure-fed to the delivery port through the delivery flow path by the pump, the liquid is dispensed to the outside through the dispensing hole. It is also known that, in some cases, the nozzle is fitted rotatably to the dispenser main body and that rotating the nozzle permits the dispensing hole to be switched between an opened and a closed state.

Such a nozzle is generally formed into a shape including a partition wall provided with the dispensing hole, a cylindrical outer circumferential wall integrally provided around an outer circumference of the partition wall, and an annular locking projection integrally provided on an inner circumferential surface of the outer circumferential wall to protrude from the inner circumferential surface toward the inner side in the radial direction, by injection molding a resin material with use of a mold. On the other hand, the dispenser main body is provided integrally with a cylindrical fitted portion that communicates with the delivery port. The fitted portion is also provided, on an outer circumferential surface thereof, with a projecting portion integrally. With the outer circumferential wall of the nozzle being fitted to the outer side of the fitted portion and with the locking projection of the nozzle being in undercut engagement with the projecting portion, the nozzle is rotatably fitted to the fitted portion while being engaged with the fitted portion.

CITATION LIST

Patent Literature

PTL1: JPH11290731A

SUMMARY

Technical Problem

In the trigger-type liquid dispenser, a large amount of the liquid is dispensed in the form of spray or foam through the small dispensing hole provided in the nozzle. This means that pressure is increased in the delivery flow path and in the nozzle at the time of dispensing the liquid. Accordingly, fitting strength of the nozzle with respect to the fitted portion needs to be enhanced by increasing the degree of overlap in the undercut engagement between the locking projection, which is provided on the outer circumferential wall of the nozzle, and the projecting portion, which is provided on the outer circumferential surface of the fitted portion.

However, the attempt to increase the degree of overlap in the undercut engagement poses the following problem. That is to say, when the nozzle is fitted to the outer side of the fitted portion, the locking projection strongly contacts the projecting portion, and plastic deformation so-called a burr occurs. This causes a variation in position of the nozzle fitted to the fitted portion of the dispenser main body.

Accordingly, the present disclosure is to provide a trigger-type liquid dispenser that maintains the fitting strength of the nozzle with respect to the fitted portion sufficiently and that also improves fitting stability of the nozzle by preventing the plastic deformation caused when the nozzle is fitted.

Solution to Problem

One of aspects of the present disclosure resides in a trigger-type liquid dispenser including: a dispenser main body fitted to a mouth of a container containing a liquid; a pump configured, in response to operation of a trigger, to be actuated to pressure-feed the liquid contained in the container to a delivery port through a delivery flow path provided in the dispenser main body; and a nozzle fitted to the dispenser main body to dispense, to outside, the liquid pressure-fed to the delivery port. The dispenser main body includes a cylindrical-shaped fitted portion communicating with the delivery port. The nozzle includes a partition wall, which covers an opening end of the fitted portion and which is provided with a dispensing hole, and a tubular-shaped outer circumferential wall, which is contiguous with an outer circumference of the partition wall to cover an outer circumference of the fitted portion. The nozzle is rotatable with respect to the fitted portion between an opened position, in which the dispensing hole communicates with the delivery port, and a closed position, in which the dispensing hole is blocked from the delivery port. The outer circumferential wall includes a locking projection that protrudes toward an inner side in a radial direction from an inner circumferential surface of the outer circumferential wall and that is in undercut engagement with a projecting portion provided on an outer circumferential surface of the fitted portion to thereby hold the nozzle in engagement with the fitted portion. The locking projection is provided, in an inner edge portion thereof, with a concave portion, in which a degree of the undercut engagement with the projecting portion is reduced when the nozzle is located between the opened and the closed position.

In a preferred embodiment of the trigger-type liquid dispenser according to the present disclosure, the nozzle is configured in a manner such that the nozzle comes to the closed position when being rotated 90 degrees to one side with respect to the fitted portion from the opened position, and the concave portion is arranged to engage with the projecting portion in a state where the nozzle is rotated 45 degrees in a direction toward the closed position from the opened position.

In another preferred embodiment of the trigger-type liquid dispenser according to the present disclosure, the outer circumferential wall includes a rib that protrudes toward the inner side in the radial direction from the inner circumferential surface of the outer circumferential wall and that abuts against the projecting portion in a state where the locking projection is in undercut engagement with the projecting portion.

In yet another preferred embodiment of the trigger-type liquid dispenser according to the present disclosure, the nozzle includes: a nozzle main body in which the partition wall and the outer circumferential wall are formed integrally; and a nozzle cap body that is fitted to the nozzle main body, that is configured to cover the dispensing hole in an openable and closable manner via a hinge, and that is configured to change a dispensing form.

Advantageous Effect

The present disclosure provides a trigger-type liquid dispenser that maintains the fitting strength of the nozzle with respect to the fitted portion sufficiently and that also improves the fitting stability of the nozzle by preventing the plastic deformation caused when the nozzle is fitted.

DETAILED DESCRIPTION

Figure 1:
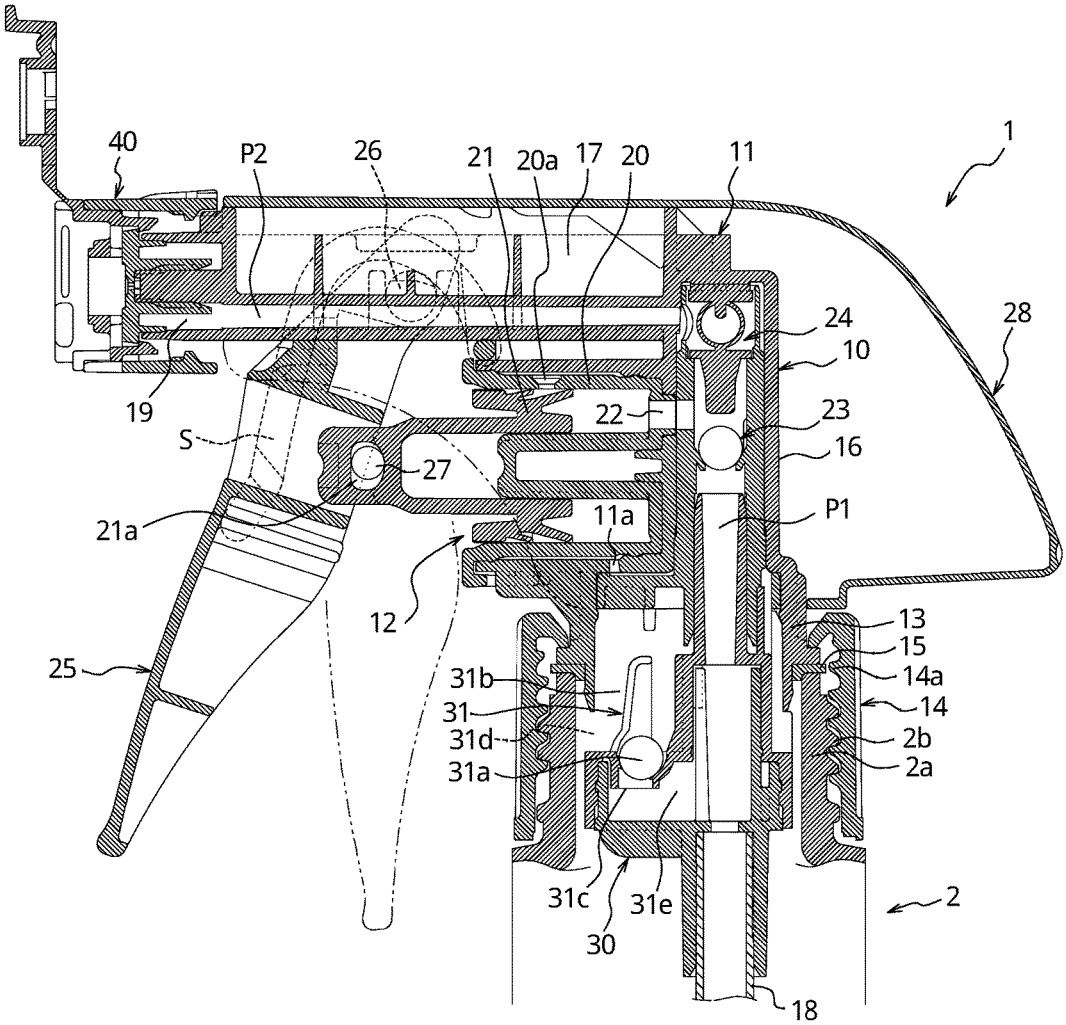
FIG. 1 is a side sectional view of a trigger-type liquid dispenser according to one of embodiments of the present disclosure.

The present disclosure will be described in more detail below by illustration with reference to the drawings. Note that, in the specification, the claims, the abstract, and the drawings herein, the side (corresponding to the upper side in FIG. 1) on which a ceiling wall of a shroud included in a dispenser main body, which is later described, is located is defined as upper direction, and the side (corresponding to the lower side in FIG. 1) on which a fitting cap is disposed is defined as lower direction. Furthermore, the side (corresponding to the left side in FIG. 1) on which the nozzle of the dispenser main body is disposed is defined as front direction, and the opposite side (corresponding to the right side in FIG. 1) is defined as rear direction. Moreover, the directions that are orthogonal to the upper-lower direction and the front-rear direction (the directions that are orthogonal to the drawing in FIG. 1) are defined as lateral sides (left and right directions).

A trigger-type liquid dispenser 1 according to one of embodiments of the present disclosure illustrated in FIG. 1 may be attached to a mouth 2*a* of a container 2 in use. The container 2 contains a liquid, such as an antimold, a detergent, a sizing agent for textiles, household wax, a hair liquid, an aromatic, a repellent, a pesticide, and a medicine, as the content liquid. FIG. 1 illustrates the state in which the trigger-type liquid dispenser 1 is attached to the mouth 2*a* of the container 2.

The trigger-type liquid dispenser 1 includes a dispenser main body 10, which is fitted to the mouth 2*a* of the container 2. The dispenser main body 10 includes a resin-made body portion 11 and a pump 12, which is fitted to the body portion 11.

A lower end of the body portion 11 serves as a coupling tube 13, and a fitting cap 14 is held to the coupling tube 13 in a manner such that the fitting cap 14 is rotatable relative to the coupling tube 13. The fitting cap 14 is formed in a cylindrical shape and is provided, on an inner circumferential surface thereof, with a female screw 14*a*. The body portion 11 is fixed to the mouth 2*a* of the container 2 by screw-connecting the female screw 14*a* to a male screw 2*b*, which is provided on an outer circumferential surface of the mouth 2*a* of the container 2, in the state where the coupling tube 13 is fitted to the mouth 2*a* of the container 2. Additionally, reference numeral 15 denotes a sealing member that seals between the mouth 2*a* of the container 2 and the coupling tube 13.

The body portion 11 is formed to have a substantially L-shape appearance including a standing portion 16, which extends from the coupling tube 13 in a direction extending along the central axis of the coupling tube 13, and also including an extension portion 17, which extends in a direction orthogonal to the standing portion 16. The standing portion 16 is provided inside thereof with an intake flow path P1, which communicates with the coupling tube 13. The intake flow path P1 has a lower end (corresponding to a lower end of an upright and inverted dual mechanism 30, which is described later) to which a drawing tube 18, which is inserted into the container 2, is connected. On the other hand, the extension portion 17 is provided with a delivery flow path P2, which extends in the direction orthogonal to the intake flow path P1. The delivery flow path P2 is provided, on a front end thereof, with a delivery port 19.

The pump 12 includes a cylinder 20, which is attached to the body portion 11, and a piston 21, which is displaceably assembled in the cylinder 20. The inside of the cylinder 20 communicates with the intake flow path P1 and the delivery flow path P2 via an outlet/inlet hole 22.

The intake flow path P1 is provided, in a portion thereof that is located on the lower side (i.e., on the upstream side) of the outlet/inlet hole 22, with the first check valve 23. The first check valve 23 operates to permit the liquid to flow from the inside of the container 2 toward the outlet/inlet hole 22 and to prevent the liquid, after being discharged through the outlet/inlet hole 22 in response to actuation of the pump 12, from flowing toward the container 2 through the intake flow path P1. Similarly, the delivery flow path P2 is provided, in a portion inside thereof that is located on the upper side (i.e., on the downstream side) of the outlet/inlet hole 22, with the second check valve 24. The second check valve 24 operates to permit the liquid, after being discharged through the outlet/inlet hole 22 in response to actuation of the pump 12, to flow toward the delivery port 19 through the delivery flow path P2 and to prevent the liquid from flowing from the delivery port 19 toward the outlet/inlet hole 22.

To the body portion 11, a trigger (operation lever) 25 is fitted. The trigger 25, on its one end side, is supported swingably by the body portion 11 about a pivot shaft 26. The trigger 25 is provided, in a middle portion thereof, with a pin member 27, which engages with a concave portion 21*a*, which is provided in a front end of the piston 21. Thus, the trigger 25 is rotatably coupled to the front end of the piston 21 by the pin member 27. With the trigger 25, a front end of a curve-shaped plate spring S, which has a base end fixed to and held by the body portion 10, is engaged. The plate spring S urges the trigger 25 toward a direction (i.e., a clockwise direction about the pivot shaft 26 in the figure) away from the pump 12. Additionally, the body portion 11 and the pump 12 are covered by a shroud 28, and the trigger 25 protrudes from the lower side of the shroud 28.

When the trigger 25 is pulled toward the pump 12 manually, the first check valve 23 is closed, and the piston 21 increases the liquid pressure inside the cylinder 20. Consequently, the liquid contained in the cylinder 20 is delivered from the outlet/inlet hole 22 into the delivery flow path P2 through the second check valve 24. On the other hand, when the trigger 25 is released from the operation, the trigger 25 is returned to its initial position due to resilience of the plate spring S. In conjunction with the return movement, the second check valve 24 is closed, the first check valve 23 is opened, and the liquid contained in the container 2 is drawn from the outlet/inlet hole 22 into the cylinder 21 via the tube 18 and the intake flow path P1. Additionally, the cylinder 20 is provided with an ambient air introduction port 20*a*, which is exposed to the outside when the trigger 25 is operated to its stroke limit. Air drawn through the ambient air introduction port 20*a* is then drawn into the container 2 through an annular-shaped gap defined between the cylinder 20 and the body portion 11, through a vent hole 11*a*, which is provided in the body portion 11, and through a gap defined between the upright and inverted dual mechanism 30 and the body portion 11. Accordingly, after the liquid is dispensed, the space in the container 2 is replaced with air. By thus repeating pulling and releasing operations of the trigger 25, the pump 12 may be actuated to draw the liquid contained in the container 2 through the intake flow path P1 and to pressure-feed the liquid to the delivery port 19 through the delivery flow path P2.

The body portion 11 and the pump 12 do not need to be configured as above, and it is possible to adopt a variety of configurations or structures, which permit the pump 12 to be actuated in response to operation of the trigger 25 to pressure-feed the liquid from the inside of the container 2 to the delivery port 19.

Between the intake flow path P1 and the tube 18, there is provided the upright and inverted dual mechanism 30, which permits the liquid contained in the container 2 to be supplied to the pump 12 regardless of whether the container 2, to which the trigger-type liquid dispenser 1 is fitted, is in an upright or an inverted position. The upright and inverted dual mechanism 30 includes a check valve unit 31. When the container 2 is in the upright position, the check valve unit 31 is in its closed state where a ball-shaped valve body 31*a* closes an outlet hole 31*c* of a valve chamber 31*b*, so that the liquid may be introduced to the intake flow path P1 via the tube 18. On the other hand, when the container 2 is placed in the inverted position, the check valve unit 31 is brought into its opened state by the valve body 31*a* being displaced in the valve chamber 31*b* in a direction away from the outlet hole 31*c*, so that the liquid pooled inside the coupling tube 13 may be introduced from an inlet opening 31*d*, which is provided in a side wall of the check valve unit 31, to the intake flow path P1 via the valve chamber 31*b*, the outlet hole 31*c*, and a flow path 31*e*, which is used during inversion. Thus, the liquid contained in the container 2 may be supplied to the pump 12 both in the upright and inverted positions.

To a front end of the extension portion 17 of the body portion 11, a nozzle 40 is fitted. The nozzle 40 is used to dispense the liquid, after being pressure-fed from the container 2 to the delivery port 19 by the pump 12, to the outside.

Figure 2:
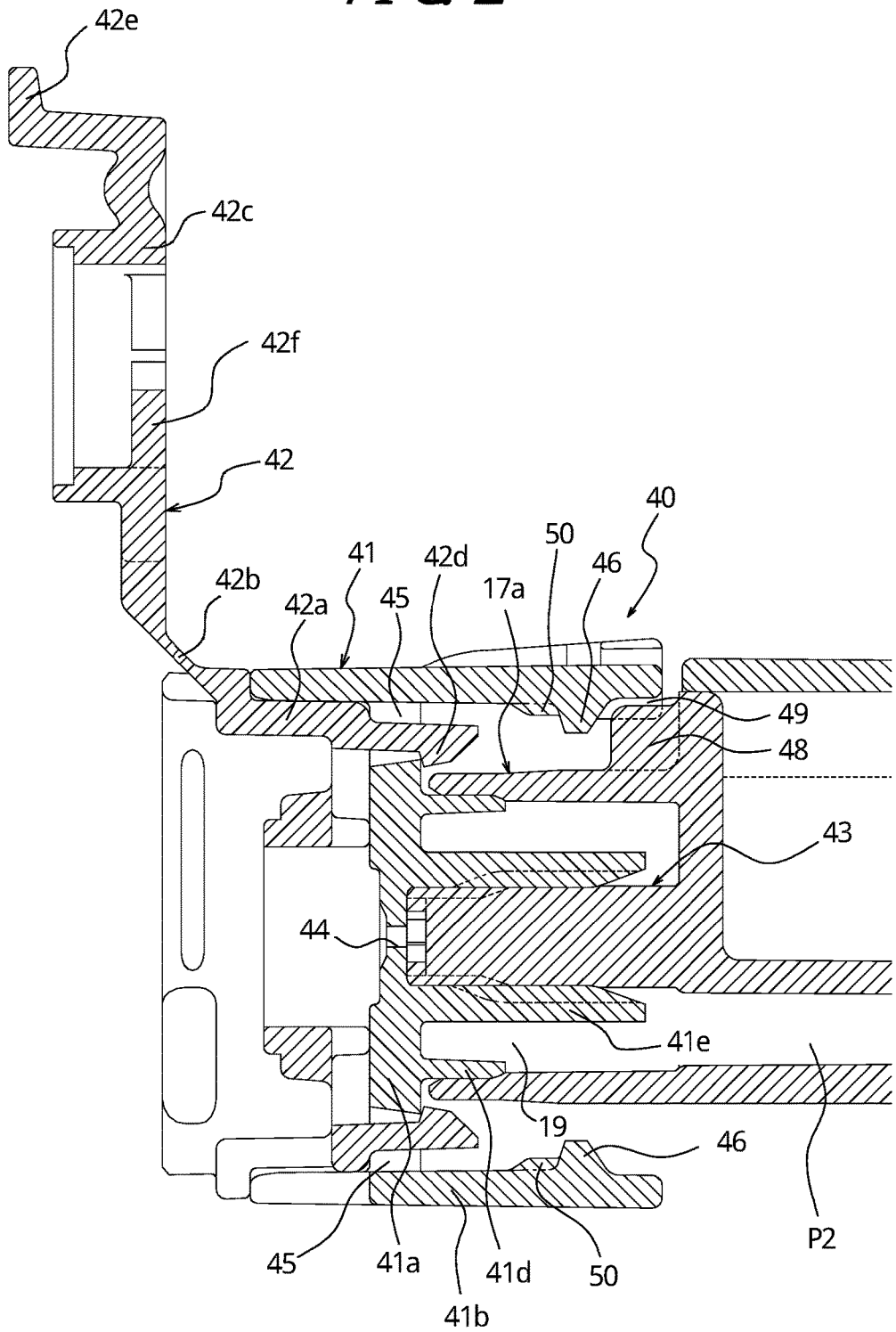
FIG. 2 is an enlarged sectional view illustrating a trigger-type liquid dispenser of FIG. 1.

As illustrated in FIG. 2, the front end of the extension portion 17 of the dispenser main body 10 is provided integrally with a fitted portion 17*a*, to which the nozzle 40 is fitted. The fitted portion 17*a* is formed in a cylindrical shape protruding from the front end of the extension portion 17, and the delivery port 19, which is an outlet end of the delivery flow path P2, is open to the lower side of the inside of the fitted portion 17*a*. That is to say, the fitted portion 17*a*, in the inside thereof, communicates with the delivery port 19 of the delivery flow path P2. Furthermore, the front end of the extension portion 17 is provided integrally with a columnar-shaped switch shaft portion 43, whose central axis is aligned with the central axis of the fitted portion 17*a*.

In the present embodiment, the nozzle 40 has a double-block structure combining a nozzle main body 41 and a nozzle cap body 42. The nozzle main body 41 and the nozzle cap body 42 are each obtained by injection molding a resin material with use of a mold. Additionally, the nozzle 40 does not necessarily need to have the double-block structure, and the nozzle main body 41 and the nozzle cap body 42 may be molded integrally. Alternatively, the nozzle 40 may be configured only by the nozzle main body 41.

The nozzle main body 41 includes a plate-shaped partition wall 41*a*, which covers an opening end of the fitted portion 17*a*, and an outer circumferential wall 41*b*, which is contiguous with an outer circumference of the partition wall 41*a* to cover an outer circumference of the fitted portion 17*a*. As can be seen from FIGS. 3A and 3B, the outer circumferential wall 41*b* has a tubular shape that is substantially square as viewed from the front side.

The partition wall 41*a* of the nozzle main body 41 is provided with a dispensing hole 44, which extends through the partition wall 41*a* along the central axis of the outer circumferential wall 41*b*. The dispensing hole 44 is a small hole that is sufficiently smaller in sectional area than the delivery port 19. The partition wall 41*a* is further provided, on an inner surface thereof that faces to the fitted portion 17*a*, integrally with a cylindrical-shaped closing tubular portion 41*d*, which is disposed coaxially with the dispensing hole 44. With the closing tubular portion 41*d* being fitted on the inner side of the fitted portion 17*a*, the partition wall 41*a* closes the opening end of the fitted portion 17*a*. Moreover, the partition wall 41*a* is provided, on the inner surface thereof, integrally with a switch tubular portion 41*e*, which is disposed coaxially with the closing tubular portion 41*d* on the inner side of the closing tubular portion 41*d*. The switch tubular portion 41*e* is fitted on the outer side of the switch shaft portion 43. The closing tubular portion 41*d* and the switch tubular portion 41*e* are rotatable relative to the fitted portion 17*a* and the switch shaft portion 43. That is to say, the nozzle main body 41 is rotatable with respect to the fitted portion 17*a* about the axis of the partition wall 41*a* of the nozzle main body 41.

The switch shaft portion 43 is provided, on an outer circumferential surface in a predetermined range of the front end side thereof, with at least one groove extending in the axis line direction. The switch tubular portion 41*e* is also provided, on an inner circumferential surface thereof, with at least one groove extending in the axis line direction. These grooves are not in communication with each other when the nozzle main body 41 (nozzle 40) is in its closed position. On the other hand, these grooves are in communication with each other when the nozzle main body 41 is in its opened position in which the nozzle main body 41 is rotated 90 degrees with respect to the fitted portion 17*a* from the closed position. Accordingly, when the nozzle main body 41 is in its closed position, the dispensing hole 44 is in its closed state in which the liquid is prevented from being dispensed due to the dispensing hole 44 being blocked from the delivery port 19. When the nozzle main body 41 is in its opened position, the dispensing hole 44 is in its opened state in which the liquid may be dispensed through the dispensing hole 44 communicating with the delivery port 19. By thus rotating the nozzle 40 between the closed and the opened position, opening and closing of the dispensing hole 44 may be switched.

Figure 3A:
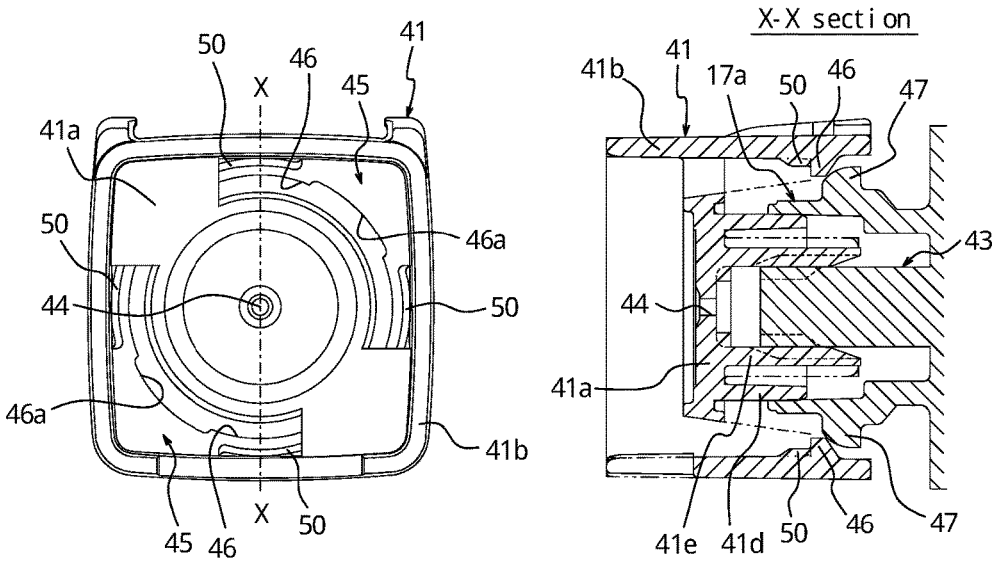
FIG. 3A is a pair of a front view and an X-X sectional view illustrating a nozzle and a fitted portion of a trigger-type liquid dispenser of FIG. 1.
Figure 3B:
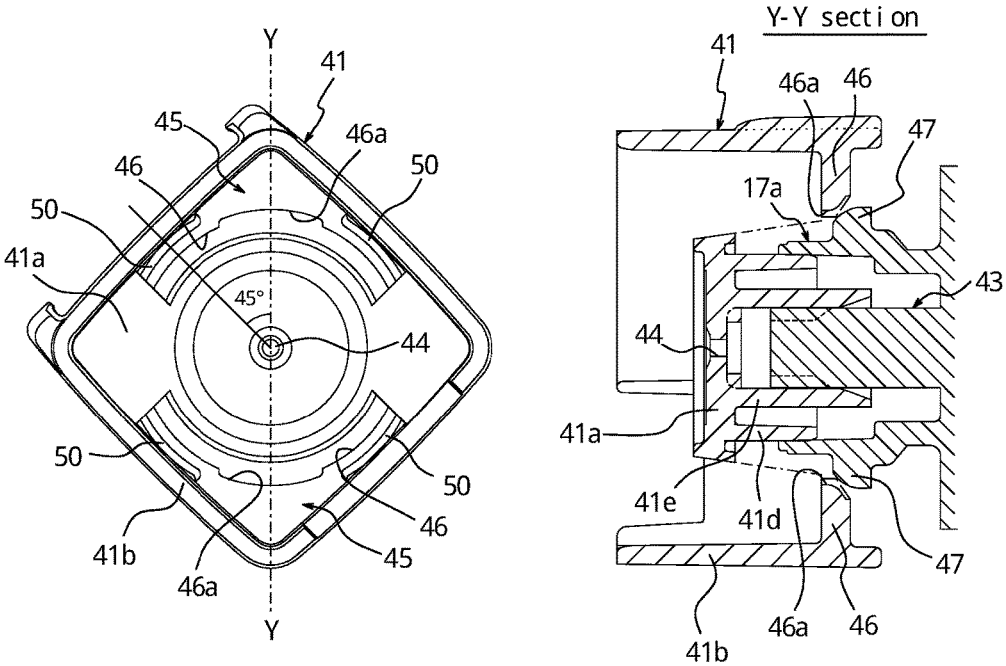
FIG. 3B is a pair of a front view and a Y-Y sectional view illustrating how a nozzle is fitted to a fitted portion.

Herein, FIGS. 3A and 3B illustrate the state before the nozzle main body 41 is fitted to the fitted portion 17*a*. Front views are on the left side, and an X-X sectional view and a Y-Y sectional view are on the right side. As illustrated in the sectional views of FIGS. 3A and 3B, the fitted portion 17*a* is provided, on an outer circumferential surface thereof, with a pair of projecting portions 47, which are in undercut engagement with locking projections 46, which are later described. These protruding portions 47 are each formed in a plate shape protruding to the outer side in the radial direction from the outer circumferential surface of the fitted portion 17*a* and has a width in the circumferential direction that is approximately ¼ of the width of the corresponding locking projection 46. Additionally, although in the present embodiment the pair of projecting portions 47 is disposed on the left and the right side on the outer circumferential surface of the fitted portion 17*a*, the present disclosure is not limited to this embodiment. The pair of projecting portions 47 may be disposed on the upper and the lower side or any other sides.

As illustrated in the front views of the nozzle main body 41 of FIGS. 3A and 3B, the partition wall 41*a* of the nozzle main body 41 is provided with a pair of through holes 45, which extends along a joining portion between the partition wall 41*a* and the outer circumferential wall 41*b*. These through holes 45 each extend in a range of approximately 90 degrees about the central axis of the outer circumferential wall 41*b* and are formed as a pair of arc-shaped holes disposed in point symmetry about the central axis of the outer circumferential wall 41*b*.

Furthermore, the outer circumferential wall 41*b* of the nozzle main body 41 is provided with the pair of locking projections 46, which protrudes toward the inner side in the radial direction from an inner circumferential surface of the outer circumferential wall 41*b*. In the state where the nozzle main body 41 is fitted to the fitted portion 17*a*, the locking projections 46 are in undercut engagement with the projecting portions 47 of the fitted portion 17*a*. Accordingly, the nozzle main body 41 (the nozzle 40) is locked in a direction extending along the central axis thereof and is prevented from being detached from the fitting portion 17*a* by the projecting portions 47 while being held rotatably with respect to the fitted portion 17*a*. Additionally, the pair of locking projections 46 are disposed in point symmetry with each other within a range of approximately 90 degrees. Accordingly, even when the nozzle main body 41 is rotated between the closed and the opened position, the locking projections 46 are locked by the projecting portions 47, and the nozzle main body 41 is prevented from being detached from the fitted portion 17*a*.

As illustrated in FIGS. 3A and 3B, these locking projections 46 are each formed in an arc shape extending circumferentially along the inner circumferential surface of the outer circumferential wall 41*b* in the same range as the range of the corresponding through hole 45 so that the locking projection 46 is located in the range overlapping with the corresponding through hole 45 as viewed from a direction extending along the central axis of the outer circumferential wall 41*b*.

As illustrated in FIGS. 3A and 3B, each locking projection 46 is provided, in an inner edge portion in the radial direction thereof, with a concave portion 46*a*, which is recessed toward the outer side in the radial direction. The concave portion 46*a* is provided in a middle region in the circumferential direction of the inner edge portion of the locking projection 46. A width in the circumferential direction of the concave portion 46*a* is slightly greater than that of the corresponding projecting portion 47. As illustrated in FIG. 3B, the concave portion 46*a* in the present embodiment is provided in a manner such that the concave portion 46*a* comes to a position corresponding to the projecting portion 47 when the nozzle main body 41 is rotated 45 degrees in a rotational direction from the opened or the closed position. The degree of overlap in the undercut engagement between the locking projection 46 and the projecting portion 47 is reduced in the concave portion 46*a* of the locking projection 46. Accordingly, to fit the nozzle main body 41 to the fitted portion 17*a*, the concave portion 46*a*, in alignment with the projecting portion 47, is simply pushed in the axis line direction. By doing so, the locking projection 46 climbs over the projecting portion 47 easily. This prevents occurrence of the plastic deformation due to strong contact between the locking projection 46 and the projecting portion 47.

Furthermore, the outer circumferential wall 41*b* is provided with ribs 50, which protrude toward the inner side in the radial direction from the inner circumferential surface of the outer circumferential wall 41*b*. The ribs 50 abut against the projecting portions 47 in the state where the locking projections 46 are in undercut engagement with the projecting portions 47. This prevents rattling of the nozzle main body 41 in the state where the nozzle main body 41 is fitted to the fitted portion 17*a*. In order to provide the effect of reducing the rattling, the ribs 50 do not necessarily need to abut against the projecting portions 47 as long as the ribs 50 are provided to be adjacent to the projecting portions 47 in the state where the locking projections 46 are in undercut engagement with the projecting portions 47. Furthermore, when being provided intermittently in the circumferential direction, the ribs 50 reduce sliding friction caused by rotation of the nozzle 40 between the opened and the closed position. Additionally, in the present embodiment, the ribs 50 are arranged in four locations, that is to say, in the upper, the lower, the left, and the right part, on the outer circumferential wall 41*b* so that the ribs 50 abut against the projecting portions 47 when the nozzle 40 is in the opened and the closed position. The width in the circumferential direction of each rib 50 is approximately ¼ the width of each locking projection 46.

Additionally, reference numeral 48 denotes a projection provided on the outer circumferential surface of the fitted portion 17*a*. The projection 48 climbs over a projection 49, which is provided on the inner circumferential surface of the outer circumferential wall 41*b*, and this provides a click sensation when the nozzle main body 41 is rotated to the opened or the closed position. Furthermore, each locking projection 46 is provided, on both sides thereof, with stoppers S (which are not shown). Each of these stoppers S, against which the corresponding projecting portion 47 abuts, regulates the rotational angle of the nozzle main body 41 to be 90 degrees. By rotating the nozzle main body 41 in the range of 90 degrees, the dispensing hole 44 may be switched from the closed to the opened state, or from the opened to the closed state.

The nozzle cap body 42 includes a holding portion 42*a*, which is fitted to the inner side of the outer circumferential wall 41*b*, and a cover portion 42*c*, which is provided in an openable and closable manner via a hinge 42*b*. The holding portion 42*a* is provided with a locking claw 42*d*. The locking claw 42*d* is inserted through the through holes 45 of the nozzle main body 41 to be in undercut engagement with a rear surface of the partition wall 41*a*, thereby holding the nozzle cap body 42 in engagement with the nozzle main body 41. The cover portion 42*c* is provided, on a front end thereof, integrally with a tab portion 42*e*, which is held for opening and closing operations of the cover portion 42*c*. The cover portion 42*c* is also provided with a columnar-shaped projection 42*f*, with which the liquid dispensed in the form of spray from the dispensing hole 44 collides to be turned into foam in the closed position. The cover portion 42*c*, which covers the dispensing hole 44 in the closed position and which serves to change the form of dispensing the liquid dispensed from the dispensing hole 44, may have any shape etc. Furthermore, the cover portion 42*c* may also be a closing cap that simply covers the dispensing hole 44 to prevent the content liquid from being dispensed.

In the trigger-type liquid dispenser 1 with the above configuration according to the present embodiment, at the time of fitting the nozzle main body 41 to the fitted portion 17*a*, the nozzle main body 41 is pushed in easily with a little force by aligning the concave portions 46*a* with the projecting portions 47 as illustrated in FIG. 3B. Besides, the plastic deformation between the locking projections 46 and the projecting portions 47 is prevented, and the fitting stability of the nozzle 40 is improved.

Meanwhile, after the nozzle 40 is fitted, the nozzle 40 is basically arranged in the opened or the closed position. Accordingly, operation is not feasible in the state where the concave portions 46*a* are in engagement with the projecting portions 47. Especially when the liquid contained in the container 2 is dispensed, the nozzle 40 is in the opened state. This ensures, as illustrated in FIG. 3A, a sufficient degree of overlap in the undercut engagement between the locking projections 46 and the projections 47, and a sufficient fitting strength of the nozzle 40 with respect to the fitted portion 17*a* is obtained. Accordingly, even when pressure is increased in the delivery flow path P2 and in the nozzle 40, there is no fear of the nozzle 40 falling off, and this permits safe use.

Furthermore, in the trigger-type liquid dispenser 1 according to the present embodiment, the outer circumferential wall 41*b* is provided with the ribs 50, which abut against the projecting portions 47 in the state where the locking projections 46 are in undercut engagement with the projecting portions 47. This prevents rattling of the nozzle 40 and accordingly, improves operability and stabilizes the dispensing form of the liquid.

Moreover, in cases where the nozzle cap body 42 is provided as in the trigger-type liquid dispenser 1 according to the present embodiment, the form of dispensing the liquid may be switched. Accordingly, the dispensing form may be changed depending on applications, and convenience is further improved.

REFERENCE SIGNS LIST

1 Trigger-type liquid dispenser
2 Container
2*a* Mouth
2*b* Male screw
10 Dispenser main body
11 Body portion
11*a* Vent hole
12 Pump
13 Coupling tube
14 Fitting cap
14*a* Female screw
15 Sealing member
16 Standing portion
17 Extension portion
17*a* Fitted portion
18 Tube
19 Delivery port
20 Cylinder
20*a* Ambient air introduction port
21 Piston
21*a* Concave portion
22 Outlet/inlet hole
23 First check valve
24 Second check valve
25 Trigger
26 Pivot shaft
27 Pin member
28 Shroud
30 Upright and inverted dual mechanism
31 Check valve unit
31*a* Valve body
31*b* Valve chamber
31*c* Outlet hole
31*d* Inlet opening
31*e* Flow path used during inversion
40 Nozzle
41 Nozzle main body
41*a* Partition wall
41*b* Outer circumferential wall
41*d* Closing tubular portion
41*e* Switch tubular portion
42 Nozzle cap body
42*a* Holding portion
42*b* Hinge
42*c* Cover portion
42*d* Locking claw
42*e* Tab portion
43 Switch shaft portion
44 Dispensing hole
45 Through hole
46 Locking projection
46*a* Concave portion
47 Projecting portion
48 Projection
49 Projection
50 Rib
P1 Intake flow path
P2 Delivery flow path
S Plate spring

The invention claimed is:

1. A trigger-type liquid dispenser comprising:

a dispenser main body fitted to a mouth of a container containing a liquid;

a pump configured to be actuated to pressure-feed the liquid contained in the container to a delivery port through a delivery flow path provided in the dispenser main body in response to operation of a trigger; and a nozzle fitted to the dispenser main body to dispense, to outside, the liquid pressure-fed to the delivery port, wherein:

the dispenser main body includes a cylindrical-shaped fitted portion communicating with the delivery port, the nozzle includes: (i) a partition wall covering an opening end of the fitted portion and including a dispensing hole, and (ii) a tubular-shaped outer circumferential wall contiguous with an outer circumference of the partition wall to cover an outer circumference of the fitted portion, and the nozzle is rotatable with respect to the fitted portion between an opened position, in which the dispensing hole communicates with the delivery port, and a closed position, in which the dispensing hole is blocked from the delivery port, the outer circumferential wall includes a locking projection that protrudes toward an inner side in a radial direction from an inner circumferential surface of the outer circumferential wall, the locking projection being in undercut engagement with a projecting portion provided on an outer circumferential surface of the fitted portion to thereby hold the nozzle in engagement with the fitted portion, and in an inner edge portion of the locking projection, the locking projection includes a concave portion cut out and recessed into the locking projection in a direction outward along the radial direction, in which a degree of the undercut engagement with the projecting portion is reduced by the concave portion when the nozzle is located between the opened and the closed position.

2. The trigger-type liquid dispenser according to claim 1, wherein the nozzle is configured to be in the closed position when rotated 90 degrees to one side with respect to the fitted portion from the opened position, and the concave portion is configured to engage with the projecting portion when the nozzle is rotated 45 degrees in a direction toward the closed position from the opened position.

3. The trigger-type liquid dispenser according to claim 2, wherein the outer circumferential wall includes a rib protruding toward the inner side in the radial direction from the inner circumferential surface of the outer circumferential wall and abutting against the projecting portion in a state where the locking projection is in the undercut engagement with the projecting portion.

4. The trigger-type liquid dispenser according to claim 3, wherein the nozzle includes:

a nozzle main body in which the partition wall and the outer circumferential wall are formed integrally; and a nozzle cap body fitted to the nozzle main body, the nozzle cap body being configured to cover the dispensing hole in an openable and closable manner by a hinge and configured to change a dispensing form.

5. The trigger-type liquid dispenser according to claim 2, wherein the nozzle includes:

a nozzle main body in which the partition wall and the outer circumferential wall are formed integrally; and a nozzle cap body fitted to the nozzle main body, the nozzle cap body being configured to cover the dispensing hole in an openable and closable manner by a hinge and configured to change a dispensing form.

6. The trigger-type liquid dispenser according to claim 1, wherein the outer circumferential wall includes a rib protruding toward the inner side in the radial direction from the inner circumferential surface of the outer circumferential wall and abutting against the projecting portion when the locking projection is in the undercut engagement with the projecting portion.

7. The trigger-type liquid dispenser according to claim 6, wherein the nozzle includes:

a nozzle main body in which the partition wall and the outer circumferential wall are formed integrally; and a nozzle cap body fitted to the nozzle main body, the nozzle cap body being configured to cover the dispensing hole in an openable and closable manner by a hinge and configured to change a dispensing form.

8. The trigger-type liquid dispenser according to claim 1, wherein the nozzle includes:

a nozzle main body in which the partition wall and the outer circumferential wall are formed integrally; and a nozzle cap body fitted to the nozzle main body, the nozzle cap body being configured to cover the dispensing hole in an openable and closable manner by a hinge and configured to change a dispensing form.

* * * * *